US005714834A

United States Patent [19]

Sieben et al.

[11] Patent Number: 5,714,834

[45] Date of Patent: Feb. 3, 1998

[54] CATHODE RAY TUBE WITH TEMPERATURE COMPENSATED DEFLECTION UNIT

[75] Inventors: Joannes H. F. C. Sieben, Eindhoven; Wilhelmine C. S. M. Van Aken, Oss; Antonius P. M. Grubben, Eindhoven; Edward P. V. Maesen, Eindhoven; Hendrik D. Van Den Berg, Eindhoven; Elisabeth L. M. Ter Burg, Eindhoven, all of Netherlands

[73] Assignee: U.S. Philips Corporation, New York, N.Y.

[21] Appl. No.: 876,721

[22] Filed: Jun. 16, 1997

Related U.S. Application Data

[63] Continuation of Ser. No. 506,510, Jul. 24, 1995, abandoned.

[30] Foreign Application Priority Data

Jul. 25, 1994 [EP] European Pat. Off. ..... 94202162

[51] Int. Cl.[6] ..... H01J 29/70

[52] U.S. Cl. ..... 313/440

[58] Field of Search ..... 313/440; 335/210, 335/212

[56] References Cited

U.S. PATENT DOCUMENTS 4,874,982 10/1989 Overdijk et al. ..... 313/440

*Primary Examiner*—Sandra L. O'Shea
*Assistant Examiner*—Vip Patel

[57] ABSTRACT

A cathode ray tube is provided with a deflection unit. The yoke is secured to a flange of a coil holder by means of connecting elements. These connecting elements are flexible in the radial direction so that differences in thermal expansion between the yoke and the rest of the deflection unit are compensated in a flexible manner. By virtue thereof, movement of the yoke relative to the coils, which leads to an irreversible change of the deflection fields, is precluded or is at least less likely.

16 Claims, 4 Drawing Sheets

CATHODE RAY TUBE WITH TEMPERATURE COMPENSATED DEFLECTION UNIT

This is a continuation of application Ser. No. 08/506,510, filed Jul. 24, 1995 abandoned.

BACKGROUND OF THE INVENTION

This invention relates to a cathode ray tube comprising a means for generating at least one electron beam and a display screen and a deflection unit for deflecting the electron beam(s) across the display screen, said deflection unit having line-deflection and field-deflection coils for deflecting the electron beam(s) in two mutually perpendicular directions, a coil holder and a yoke which surrounds at least one of said coils, and said yoke being secured to the coil holder.

Such cathode ray tubes are well-known and are used, inter alia, in television receivers and computer monitors.

The yoke surrounds the coils and increases the intensity of the field generated by said coils. In known deflection units, the coils are secured on or at a coil holder. The yoke is also secured to the coil holder, namely by cementing it to a flanaged end of the coil holder. Such a mode of fixation generally requires long curing times and is very harmful to the environment. The adhesives used harm the environment and the coil holder and the yoke which are cemented to each other cannot be separated in the processing of waste products.

A further important problem in cathode ray tubes is that irreversible displacement of the yoke with respect to the flange can occur, in assembling the cathode ray tube or during the service life of said cathode ray tube, whereby the field generated by the deflection unit changes in an irreversible manner. This has a negative effect on the picture reproduction.

OBJECTS AN SUMMARY OF THE INVENTION

It is an object of the invention to provide a cathode ray tube of the type mentioned in the opening paragraph, in which one or more of the above-mentioned problems are reduced.

To this end, a cathode ray tube in accordance with the invention is characterized in that the yoke is secured to the coil holder by means of a number of connecting elements which are provided at the periphery of the yoke and which extend between the yoke and the coil holder and which are connected to both, said connecting elements being flexible in a direction transverse to the longitudinal axis of the yoke.

Since the connections are flexible in a direction transverse to the longitudinal axis of the yoke (the radial direction), differences in thermal expansion between the yoke and the coil holder are compensated for by the connecting elements. By virtue thereof, the risk that and the degree to which the yoke moves with respect to the coil holder and hence with respect to the deflection coils (or the at least one deflection coil which is surrounded by the yoke) is reduced. It is unnecessary to cement the yoke to the coil holder, so that the time necessary for assembling the deflection unit as well as the harmful effect on the environment are reduced. Further, the yoke and the coil holder can be detached in a simple manner, for example, by breaking or cutting the connecting elements. By virtue thereof, disassembly of the deflection unit into various parts which can be processed in a simple manner and which each consist predominantly of one material (such as yoke, coil holder and coils) is simplified.

The connecting elements of the yoke preferably extend between the wide portion of the yoke and the side of the coil holder facing the display screen.

In operation, energy is dissipated in the deflection unit causing the temperature to rise. Temperatures up to 120° C. may occur. The yoke is made of another material than the flange or the coils. Consequently, an increase in temperature causes differences in thermal expansion. This leads to thermal stresses. These stresses can cause irreversible drift. In the customary method of securing the yoke to the coil holder, thermal stresses are compensated for to a certain degree by the cement between the yoke and the coil holder. There is the risk, however, of the cement drying out with time and as a result of the high temperatures. The position of the yoke and the coils relative to each other changes as a result of differences in thermal expansion. This may lead to a displacement of the yoke and the coils with respect to each other, resulting in an irreversible change of the position of the yoke relative to the coils. Further, in assembling the deflection unit, the yoke is generally aligned with respect to the coil holder and temporarily attached thereto by means of a quick-curing adhesive. In a subsequent process step, the two parts are cemented to each other. However, it happens quite often that, in the interval between the two process steps, the yoke and the coil holder move relative to each other, after which the yoke and the coil holder are cemented to each other. This causes an irreversible and undesired change of the relative positions of the yoke and the coil holder. This in turn leads to an irreversible change of the field generated by the deflection unit and, in general, adversely affects the accuracy with which the electron beam(s) is (are) deflected. This results in a permanent, undesired reduction in picture quality.

Briefly summarized, it can be said that the invention enables the yoke and the coil holder to be rapidly interconnected in an ecologically sound manner, and, preferably, the yoke can be detached from the coil holder in a simple manner and the risk of irreversible displacement of the yoke with respect to the coil holder, and hence with respect to the deflection coils, is reduced.

Preferably, the connecting elements rigidly extend in a direction along the periphery of the yoke (the transversal direction) and/or in a direction along the longitudinal axis of the yoke. By virtue thereof, microphonism (humming noise produced by the deflection unit) is reduced.

Preferably, the deflection unit comprises at least three connecting elements which are evenly distributed over the periphery of the yoke. By virtue thereof, the yoke can be suitably positioned with respect to the coil holder and the thermal expansion can be effectively compensated for.

The connecting elements preferably comprise at least a resilient element which is arranged approximately in the axial direction of the yoke.

Such an element, which can be manufactured in a simple manner, compensates for the differences in thermal expansion between the yoke and the coil holder in the radial direction.

Said connecting elements may be entirely or partly integral with a flange of the coil holder.

In an embodiment, the connecting elements are constituted by a number of connecting elements, for example, four, which are interconnected in a flexible manner, for example by means of a rib.

Such connecting elements can be processed in a simpler manner because they are interconnected and, since the connections are flexible, thermal stresses between the connecting elements do not occur in operation.

BRIEF DESCRIPTION OF THE DRAWINGS

These and other aspects of the invention will be explained in greater detail by way of example and with reference to the accompanying drawings, in which.

The Figures are schematic and are not drawn to scale, and like reference numerals generally refer to like parts.

DESCRIPTION OF THE PREFERRED EMBODIMENTS

Figure 1:
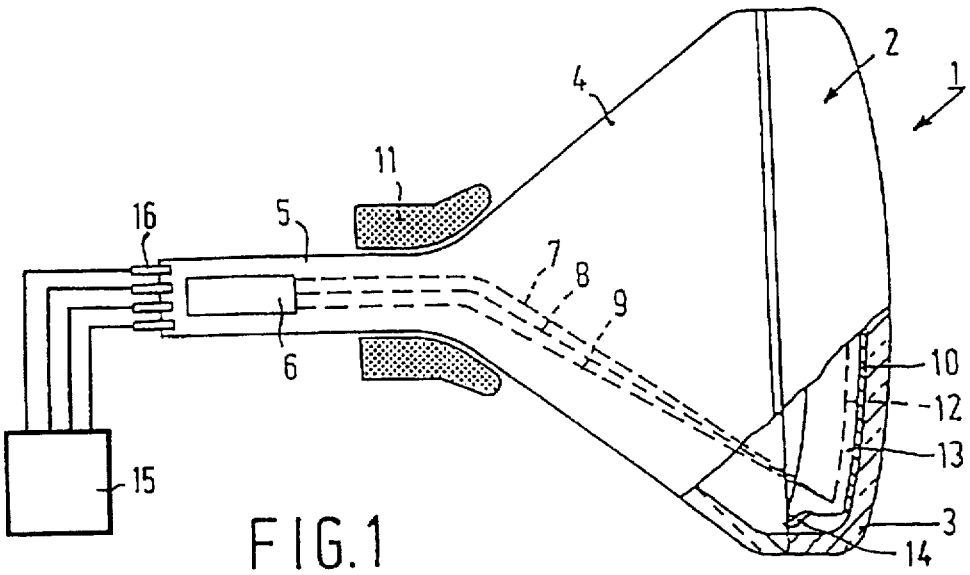
FIG. 1 shows a cathode ray tube.

FIG. 1 is a sectional view of a cathode ray tube 1, in this example a colour cathode my tube, which comprises an evacuated envelope 2 having a substantially rectangular display window 3, an enveloping portion or cone portion 4 and a neck 5. In the neck 5 there is provided an electrode system 6 for generating, in this example three, electron beams 7, 8 and 9. In this example, the electron beams are generated in one plane (in this case the plane of the drawing) and are directed to an electroluminescent display screen 10 which is provided on the inside of the display window, said display screen comprising a phosphor pattern which consists of a large number of phosphor elements luminescing in red, blue and green. Said phosphor elements may be, for example, in the form of dots or dashes. On their way to the display screen 10, the electron beams 7, 8 or 9 are deflected across the display screen 10 by means of a deflection unit 11 and pass through a colour selection electrode 12 which consists of a thin plate having apertures 13 and which is arranged in front of the display screen 10. The three electron beams 7, 8 and 9 pass through the apertures 13 of the colour selection electrode 12 at a small angle with each other and, consequently, each electron beam impinges on phosphor elements of only one colour. The colour selection electrode 12 is suspended in front of the display screen by means of suspension elements 14.

The essence of the invention is that the yoke surrounds a coil or preferably both deflection coils or coil systems, said coils are secured to a holder, and the yoke is also secured to the holder by means of connecting elements, in a manner such that the differences in thermal expansion between the holder and the yoke in the radial direction are compensated for by said connecting elements.

Hereinafter a description will be given of a number of embodiments of the invention. The principle of the invention is schematically shown in FIGS. 2 and 3.

Figure 2:
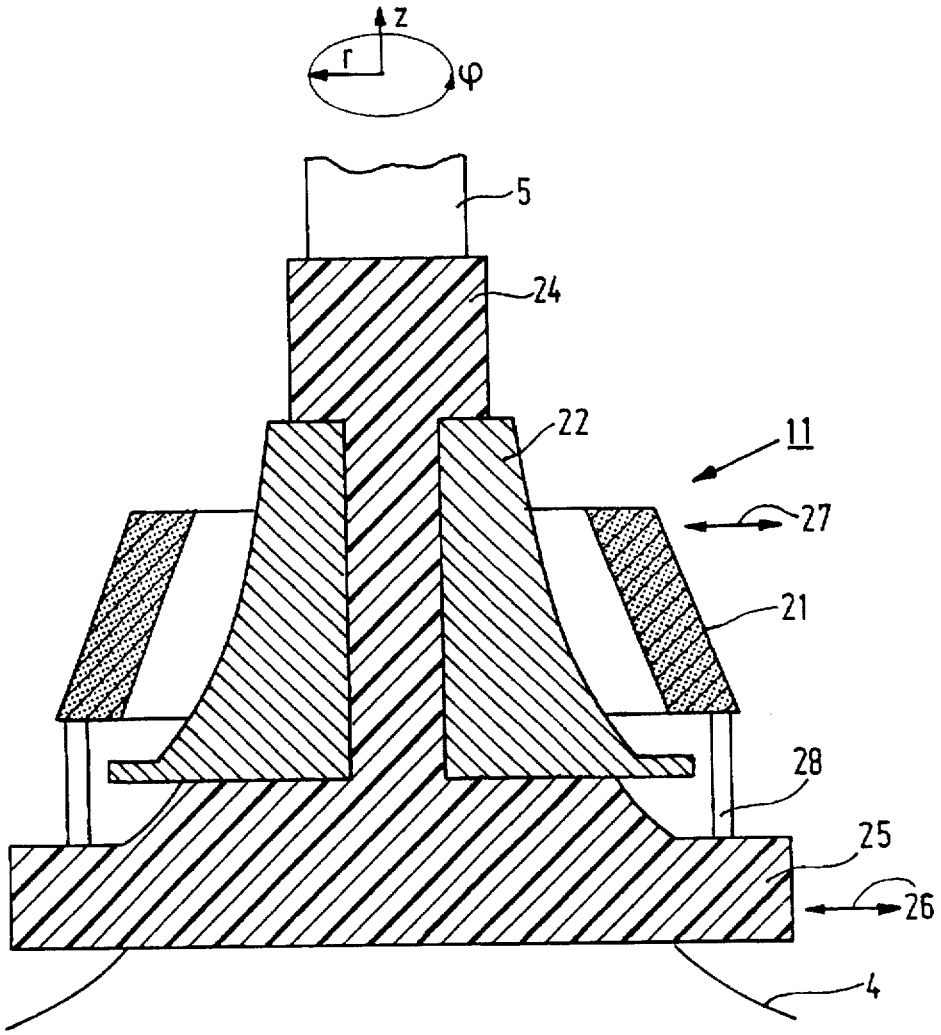
FIG. 2 shows a detail of a cathode my tube in accordance with the invention.
Figure 3:
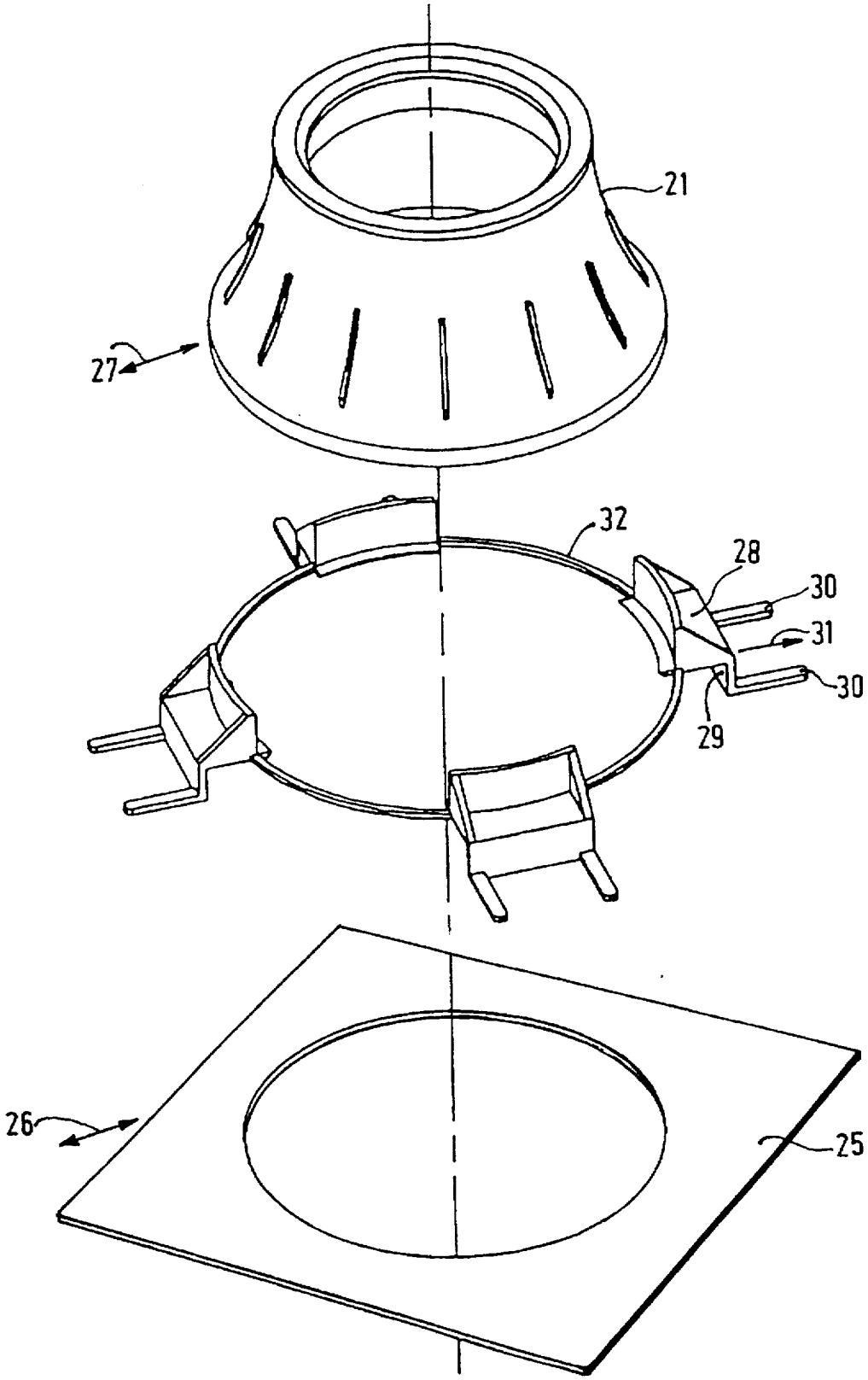
FIGS. 3, 4, 5 and 6 show detailed further embodiments of a cathode ray tube in accordance with the invention.
Figure 4:
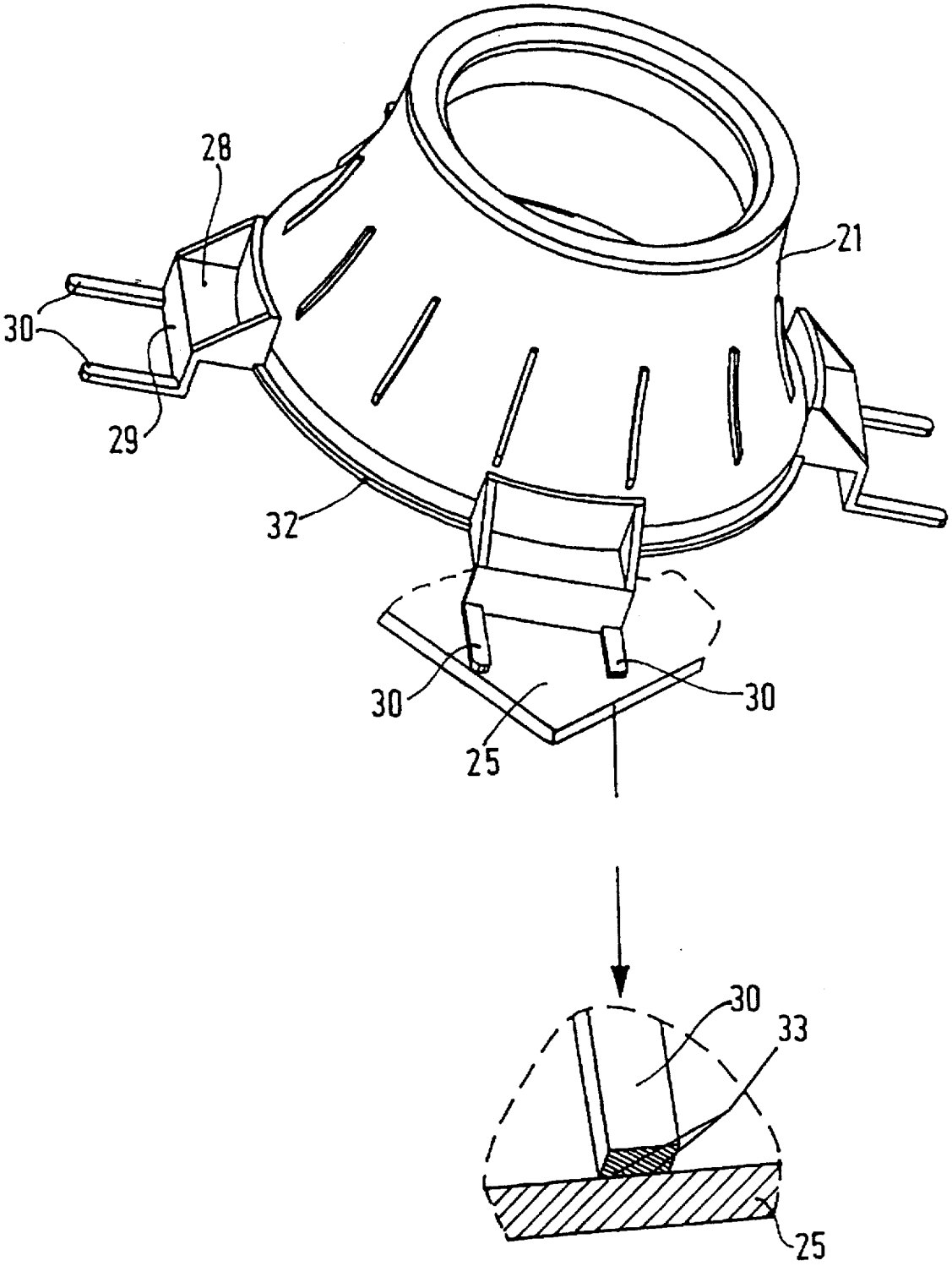

FIG. 2 shows a deflection unit 11 which, as usual, is arranged at the transition between the neck 5 and the cone portion 4. The yoke 21 surrounds the coils 22 and further coils, not shown in this Figure, but which are situated on the inside of the coil holder 24. The coils are secured to a coil holder 24 which comprises a flange 25. For the principle of the invention in the widest sense, the exact shape of the holder is not relevant. The yoke is secured to the coil holder, and in this preferred embodiment to the flange 25, by means of connecting elements 28. In operation, the temperature of the deflection unit increases. The coil holder and hence also the flange and the yoke expand radially, as shown in FIGS. 2 and 3 by means of arrows 26 and 27. In FIG. 2, also the longitudinal direction (z-direction), the radial direction (r-direction) and the transversal direction (ϕ-direction) are indicated. FIG. 3 shows in greater detail the connecting elements 28. Said connecting elements 28 are flexible in the radial (r-)direction and hence compensate for the difference in thermal expansion between the yoke and the coil holder in said direction. Preferably, the connecting elements are rigid in the other directions (z-ϕ), particularly in the z-(longitudinal) direction. The connecting elements 28 are rigid in the z- and ϕ-directions. By virtue thereof, vibrations in said directions are reduced. In this example, the connecting elements 28 comprise a portion 29 which extends in the z-direction and serves as a resilient element. This is a simple manner of forming a connecting element which is flexible in the direction 31 (r-direction) yet rigid in the other directions. The connecting elements 28 further comprise elements 30 by means of which the connecting elements 28 are secured to flange 25. The connecting elements can be secured to the flange in various ways, inter alia, by means of an adhesive, screws or ultrasonic welding. Preferably, if both the flange and the connecting element, i.e. at least the portions of the connecting elements and the flange which are to be interconnected, are made from a synthetic resin, the connecting elements are secured to the flange by means of ultrasonic welding. This is preferred over other methods such as gluing or screwing. If screws are used, force is exerted on the connection and changes in temperature may lead to relaxation which may cause an irreversible change of the position. A glued joint may be subject to ageing, which may also lead to an irreversible change of the position. These effects do not occur, or to a much smaller degree, when ultrasonic welding is applied. In FIG. 3, the yoke is secured to the flange by means of four connecting elements. The number of connecting elements can be varied, but is preferably more than two. This enables the yoke to be suitably positioned with respect to the flange and hence with respect to the coil holder. In particular, undesired tilting of the yoke with respect to the coil holder is precluded in this manner. Preferably, the number of connecting elements does not exceed six. If more than six connecting elements are used, it is difficult to arrange the yoke in a suitable position. The connecting elements may be individually produced and secured to the yoke. The Figure shows a preferred embodiment in which, in this example, four connecting elements are interconnected by flexible annular members 32. Said members ensure that the four connecting elements 28 form a coherent assembly and that the connecting elements are approximately evenly distributed over a circle. FIG. 4 shows, in some detail, a yoke with connecting elements 28. Said connecting elements 28 are provided with projections 30. In this example, these projections are secured at positions 33 to flange 25, of which only a part is shown in this Figure, by means of ultrasonic welding.

It will be obvious that within the scope of the invention many variations are possible to those skilled in the art.

For example, the connecting elements are preferably predominantly made from a material which has substantially the same coefficient of expansion as the material of the flange. By virtue thereof, thermal stresses between the flange and the connecting, elements are minimized. The connecting elements may be integral with the flange. This leads to a saving of one part.

Figure 5:
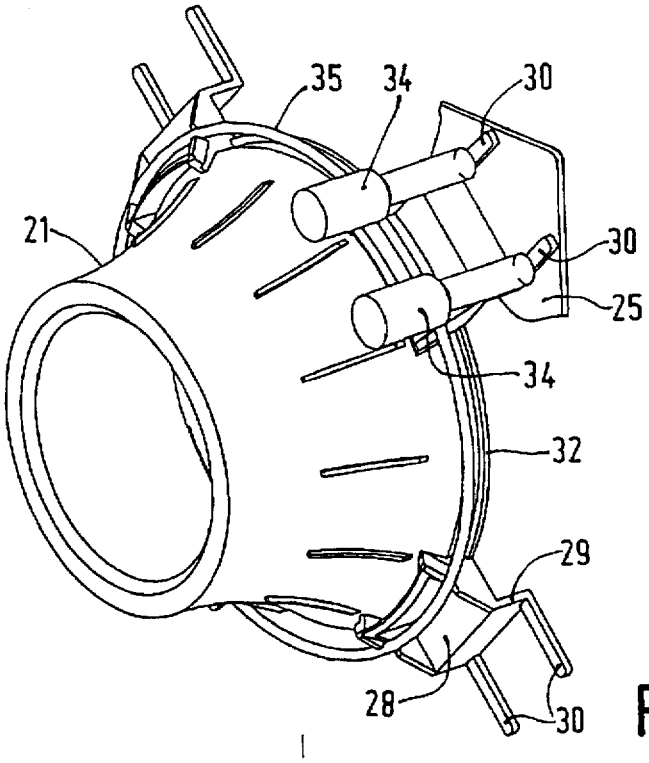

FIG. 5 shows how elements 30 are welded to the flange 25 by means of ultrasonic electrodes 34. The connecting elements 28 can be attached to the yoke 21 by means of a glued joint, or as shown in the preferred embodiment of FIG. 5, by means of a clamping ring 35. This clamp construction is preferred as it enables the connecting elements to be detached from the yoke in a simple manner.

Figure 6:
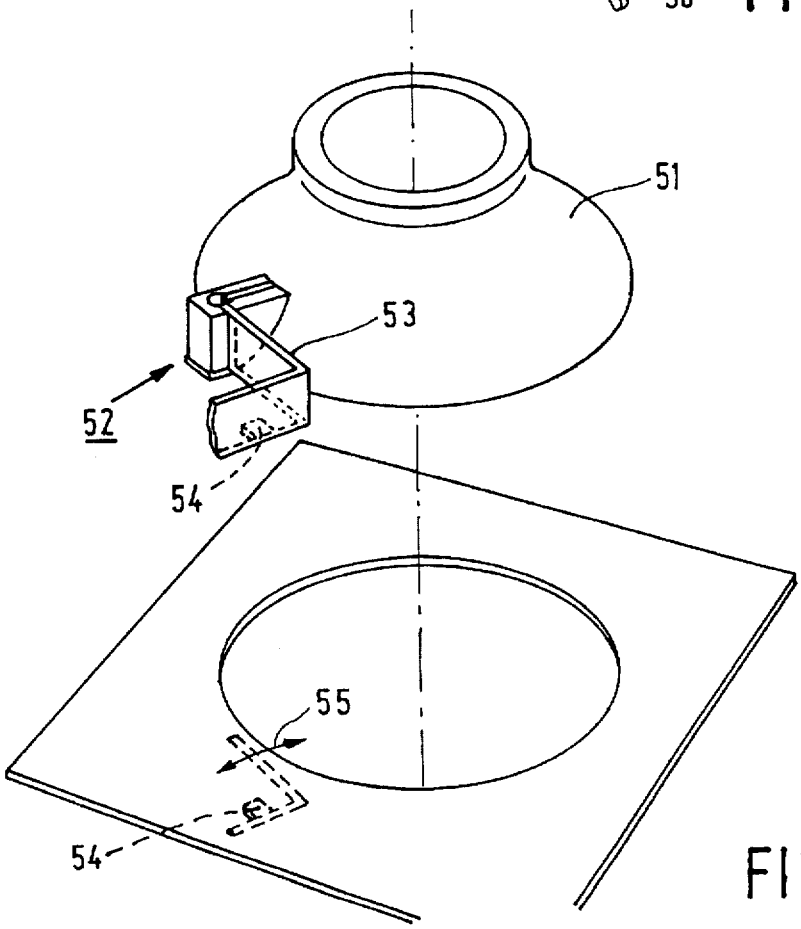

FIG. 6 shows a further embodiment of the invention. In this example, connecting elements 52 are secured to the yoke 51. This connecting element 52 comprises an L-shaped element 53. The connecting element 52 is secured to the flange at position 54. The connecting element 52 is flexible in the direction 55 and, hence, is capable of compensating for differences in thermal expansion between the yoke and the coil holder.

The examples shown comprise connecting elements which are situated at the (wide) end of the yoke facing the display screen. In other embodiments of the invention, the connecting elements may be situated at the (narrow) end of the yoke facing the neck. Preferably, the connecting elements are situated, as shown, at the wide end of the yoke because that is the place where the largest differences in thermal expansion occur.

In summary, it can be said that a cathode ray tube in accordance with the invention comprises a deflection unit, and the yoke is secured by means of connecting elements to the coil holder and, preferably to a flange. These connecting elements are flexible in the radial direction so that differences in thermal expansion between the yoke and the rest of the deflection unit can be compensated for in a flexible manner. By virtue thereof, movement of the yoke with respect to the coils, leading to an irreversible change of the deflection fields, is precluded or at least less likely.

We claim:

1. A cathode ray tube comprising: means for generating at least one electron beam, a display screen and a deflection unit for deflecting the at least one electron beam across the display screen, said deflection unit having line-deflection and field-deflection coils for deflecting the at least one electron beam in two mutually perpendicular directions, a coil holder and a yoke which surrounds at least one of said coils, and wherein said yoke is secured to the coil holder by means of a number of connecting elements which are provided at the periphery of the yoke and which are flexible in a direction radially transverse to the longitudinal axis of the yoke, the flexibility of the connecting elements in said radial direction providing compensation for differences in thermal expansion of the yoke and the coil holder due to different thermal coefficients of expansion of the materials thereof.

2. A cathode ray tube as claimed in claim 1, wherein the deflection unit comprises at least three connecting elements which are evenly distributed around the periphery of the yoke.

3. A cathode ray tube as claimed in claim 2, wherein the deflection unit comprises maximally six connecting elements which are evenly distributed around the periphery of the yoke.

4. A cathode ray tube as claimed in claim 1, wherein the connecting elements are interconnected by means of flexible annular members.

5. A cathode ray tube as claimed in claim 4 wherein the connecting elements are made of a material having substantially the same coefficient of thermal expansion as the material of the coil holder.

6. A cathode ray tube as claimed in claim 1, wherein the connecting elements are made from a material which has substantially the same coefficient of thermal expansion as the material of the coil holder.

7. A cathode ray tube as claimed in claim 6, wherein the connecting elements and the coil holder are secured to each other by means of ultrasonic welding.

8. A cathode ray tube as claimed in claim 1, wherein the connecting elements and the coil holder are secured to each other by means of ultrasonic welding.

9. A cathode ray tube as claimed in claim 1, wherein the connecting elements are secured to the yoke at the wide end of the yoke.

10. A cathode ray tube as claimed in claim 1 wherein the coil holder comprises a flange at an end thereof facing the display screen, and the yoke is secured to said flange by means of said connecting elements.

11. A cathode ray tube as claimed in claim 10 wherein the connecting elements are made of a material which has substantially the same coefficient of thermal expansion as the material of the flange.

12. A cathode ray tube as claimed in claim 10 wherein a surface of each of said connecting elements is secured to and is in intimate contact with a surface of the flange by means of an ultrasonic weld therebetween.

13. A cathode ray tube as claimed in claim 12 wherein contacting portions of the connecting elements and the flange are made from a synthetic resin.

14. A cathode ray tube as claimed in claim 1 wherein said connecting elements each include an L-shaped part for securing the yoke to the coil holder.

15. A cathode ray tube as claimed in claim 1 further comprising a flexible annular member around the yoke and which interconnects the connecting elements.

16. A cathode ray tube as claimed in claim 1 wherein said cathode ray tube comprises a color tube and said generating means generates three electron beams and said display screen comprises red, green and blue phosphor elements.

* * * * *